US006920910B2

(12) United States Patent
Hermann et al.

(10) Patent No.: US 6,920,910 B2
(45) Date of Patent: Jul. 26, 2005

(54) CASTING DEVICE, PROCESS FOR PRODUCING A CASTING DEVICE AND METHOD OF USING THE CASTING DEVICE

(75) Inventors: Wolfgang Hermann, Muelheim a.d. Ruhr (DE); Frank Scheppe, Herzogenrath (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/167,587

(22) Filed: Jun. 13, 2002

(65) Prior Publication Data

US 2003/0012895 A1 Jan. 16, 2003

(30) Foreign Application Priority Data

Jun. 13, 2001 (EP) ..... 01114393

(51) Int. Cl.[7] ..... B22C 9/02

(52) U.S. Cl. ..... 164/349; 164/361; 164/364; 164/122.1

(58) Field of Search ..... 164/349, 361, 164/364, 365, 369, 122.1, 122.2

(56) References Cited

U.S. PATENT DOCUMENTS

| | | | | | |
|---|---|---|---|---|---|
| 3,206,810 | A | * | 9/1965 | Hockin et al. | 164/519 |
| 3,537,949 | A | * | 11/1970 | Brown et al. | 428/472 |
| 3,862,660 | A | * | 1/1975 | Sakabe et al. | 164/349 |
| 3,863,701 | A | * | 2/1975 | Niimi et al. | 164/98 |
| 3,903,950 | A | * | 9/1975 | Lirones | 164/518 |
| 4,093,017 | A | * | 6/1978 | Miller et al. | 164/28 |
| 4,223,716 | A | * | 9/1980 | Ostrowski | 164/519 |
| 5,335,717 | A | * | 8/1994 | Chin et al. | 164/519 |
| 6,284,694 | B1 | * | 9/2001 | Moeltgen et al. | 501/127 |

FOREIGN PATENT DOCUMENTS

| | | | |
|---|---|---|---|
| CH | 645283 | | 9/1984 |
| DE | 19821770 | | 4/1999 |
| EP | 0370751 | | 5/1990 |
| EP | 0 415 646 | * | 3/1991 |
| GB | 1344090 A | | 1/1974 |
| JP | 2001071114 | | 3/2001 |

* cited by examiner

*Primary Examiner*—Jonathan Johnson
*Assistant Examiner*—Len Tran
(74) *Attorney, Agent, or Firm*—Harness, Dickey & Pierce, P.L.C.

(57) ABSTRACT

A casting device includes a wall which is formed in the manner of a sandwich structure from a front layer, a yielding intermediate layer and a supporting outer layer. In this way, the contraction-related internal stresses which occur during cooling are kept at a low level by the resilient properties of the intermediate layer. As such, the formation of cracks in the component to be cast can be avoided.

24 Claims, 2 Drawing Sheets

CASTING DEVICE, PROCESS FOR PRODUCING A CASTING DEVICE AND METHOD OF USING THE CASTING DEVICE

This application claims priority under 35 U.S.C. § 119 on European Application No. EP 01114393.0 which has a filing date of Jun. 13, 2001, the entire contents of which are hereby incorporated by reference.

1. Field of the Invention

The invention generally relates to a casting device for casting a metallic component. The invention also generally relates to a process and a method of use of a casting device of this type.

2. Background of the Invention

A casting process and a casting device for producing a metallic hollow body are described in DE 198 21 770 C1. The casting device comprises an outer casting mold, which has at least one inner core which is used to form the cavity of the hollow body. The outer casting mold is designed so that it can be split into at least two outer parts, and the inner core is connected to an outer part of the outer casting mold by means of at least one connecting element, which is used to form a passage opening in the wall leading into the cavity. The casting device shown is used to cast hollow gas turbine blades or vanes. Gas turbine blades or vanes of this type are subject to very high thermal loads in operation. Therefore, materials which are able to withstand high thermal loads, such as for example superalloys, are frequently used for such components. However, such materials may cause difficulties in the casting process during production.

SUMMARY OF THE INVENTION

It is an object of an embodiment of the invention to provide a casting device for casting a metallic component by which, in particular, the formation of cracks is reduced. Further objects of embodiments of the invention are to correspondingly describe the production and use of a casting device.

According to an embodiment of the invention, an object relating to a casting device may be achieved by a casting device for casting a metallic component in a cavity which is delimited by the casting device, having a front layer, which faces the cavity, and an intermediate layer, which adjoins the front layer, the intermediate layer being designed to be sufficiently soft to yield to cooling-related contraction of the metallic component.

This sandwich-like structure of the casting device for the first time represents a deviation from a completely rigid configuration of the casting device, with the introduction of a yielding intermediate layer which resiliently compensates for contraction of the metallic component. The metallic component contracts as a result of the thermally induced reduction in length. In the case of a rigid casting device, this leads to high internal stresses being built up in the component. As a result, cracks may form and have an adverse effect on the quality of the component. If a relatively soft intermediate layer is now provided, this contraction of the metallic component is yielded to. The internal stresses which occur during cooling are therefore considerably lower than with a rigid casting device. At the same time, the front layer ensures that accurate contours are maintained despite the relatively soft intermediate layer.

A) The front layer is preferably substantially free of silicon dioxide. This leads to a particularly low likelihood of a chemical reaction with the metallic component.

B) The intermediate layer is preferably substantially free of silicon dioxide.

C) The intermediate layer preferably includes ground corundum as the base material of the intermediate layer. Furthermore, it is preferable for Mowiol to be added as binder to the intermediate-layer base material. It is also preferable for octanol to be added to the intermediate-layer base material as defoamer.

D) The front layer preferably includes ground corundum as the base material of the front layer. Furthermore, it is preferable for Mowolith to be added as binder to the front-layer base material. Furthermore, it is preferable for octanol to be added to the front-layer base material as defoamer. Mowiol and Mowolith are water-based ceramic binders. The binding mechanism is effected via removal of water (polycondensation) and not via sol-gel formation based on Si. Octonal is octane alcohol, $C_8H_{17}$—OH, and is used for defoaming as a result of the reduction in surface tension.

E) There is preferably an outer layer, which surrounds the intermediate layer, adjoins the intermediate layer and is sufficiently hard to support the intermediate layer in such a manner that the latter retains its shape. An outer layer of this type, which in particular consists of a hard ceramic material which is otherwise customary for mold shells, supports the relatively soft intermediate layer, so that the casting device remains easy to operate and is not subject to any changes in shape.

F) The casting device preferably comprises a mold shell which includes the front layer and the intermediate layer, and also a casting core which includes the front layer and the intermediate layer. The casting core is arranged in the mold shell in such a way that the cavity remains between the mold shell and the casting core. An arrangement of this type is used to cast hollow metallic components or those which have undercuts or holes. During contraction of the metallic component as a result of cooling, high forces are exerted in particular on the casting core, and in the conventional casting core these result in the above-mentioned (high) internal stresses in the metallic component. Therefore, the structure having the resilient intermediate layer is particularly advantageous especially in the casting core.

Of course, the statements made under points A) to F) may also be combined with one another.

An object relating to the provision of a process maybe achieved by a process for producing the casting device in accordance with one of the designs described above, in which the casting device is hardened by a firing operation, the firing temperature being below 1300° C.

Limiting the firing temperature ensures that the sandwich-like structure comprising front layer and intermediate layer is sufficiently hardened but, at the same time, the yielding property of the intermediate layer is not impaired.

The casting core is preferably filled with a filler material and is then hardened by a firing operation, the filler material burning during the firing operation, with the result that the casting core is formed as a hollow core. In particular, polystyrene beads are a suitable filler material: The casting core is stabilized in this way. The stabilizing can be eliminated after the hardening of the casting core during the firing operation.

According to an embodiment of the invention, an object relating to the provision of a method of use may be achieved by the use of a casting device in accordance with one of the above designs for casting a metallic component from an intermetallic nickel-aluminum alloy.

When using an intermetallic nickel-aluminum alloy, there is a sudden change from ductile to brittle materials properties during the cooling. In materials of this type, this leads to particular susceptibility to the formation of cracks during contraction of the metal. The yielding properties of the intermediate layer therefore provide particularly substantial advantages for this group of materials.

The component may preferably be a gas turbine blade or vane or a heat shield element.

BRIEF DESCRIPTION OF THE DRAWINGS

The invention is explained in more detail by way of example with reference to the drawings, in which, in some cases diagrammatically and not to scale.

Identical reference symbols have the same meaning throughout the various figures.

DETAILED DESCRIPTION OF THE PREFERRED EMBODIMENTS

Figure 1:
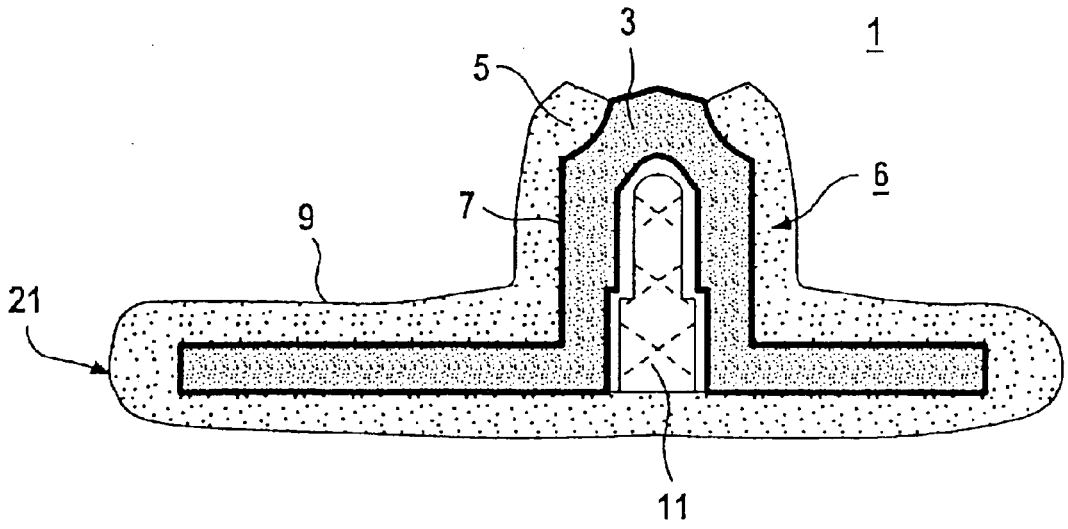
FIG. 1 shows a casting device for casting a heat shield element.

FIG. 1 shows a longitudinal section through a casting device 1. The casting device 1 is suitable for casting a heat shield element. Greater details about such heat shield elements are given below in connection with FIG. 3. The casting device 1 has a cavity 3 which is intended to receive liquid metal. The cavity 3 is delimited by a wall 6. The wall 6 is composed of a plurality of layers in a sandwich-like structure: A front layer 7 adjoins the cavity 3. The front layer 7 is surrounded by an intermediate layer 5. The intermediate layer 5 is in turn adjoined by an outer layer 9. The wall 6 therefore forms a mold shell 21 for casting a heat shield element. For subsequent accommodation of a holding bolt, a central, approximately cylindrical space 11 of the mold shell 21 penetrates through the cavity 3.

An intermetallic nickel-aluminum alloy is used as the liquid metal which is introduced into the cavity 3. It cools in the mold shell 21 and contracts in the process. This contraction causes internal stresses to build up in the crystallized metal. The intermediate layer 5 is now of resilient design, so that the contraction of the metal is resiliently absorbed by compression of the intermediate layer 5. As a result, the internal stresses which are induced in the metal remain so low that no cracks are formed. At the same time, the front layer 7 is designed to be free of silicon dioxide, so that there are no reactions between the molten metal and the material of the intermediate layer. The outer layer 9 is formed from a ceramic which is used in conventional mold shells. This imparts the required stability to the entire mold shell 21.

The front layer selected is a material which uses very fine ground corundum, somewhat coarser ground corundum and corundum powder with a grain size of up to 0.12 mm as the base material of the front layer. Silica-free water-based Mowolith is added as binder to this front-layer base material. There is no need for a wetting agent. Octanol is used as defoamer. The intermediate layer is composed of an intermediate-layer base material comprising fine ground corundum and corundum powder with a grain size of up to 0.12 mm, as well as a binder comprising silica-free water-based Mowiol. Octanol is likewise used as defoamer. In this case too, there is no wetting agent used. Corundum with a grain size of up to 0.25 mm for the front layer, up to 0.5 mm for the intermediate layer and up to 1 mm for the outer layer is used as a grain material which facilitates release of the workpiece.

Figure 2:
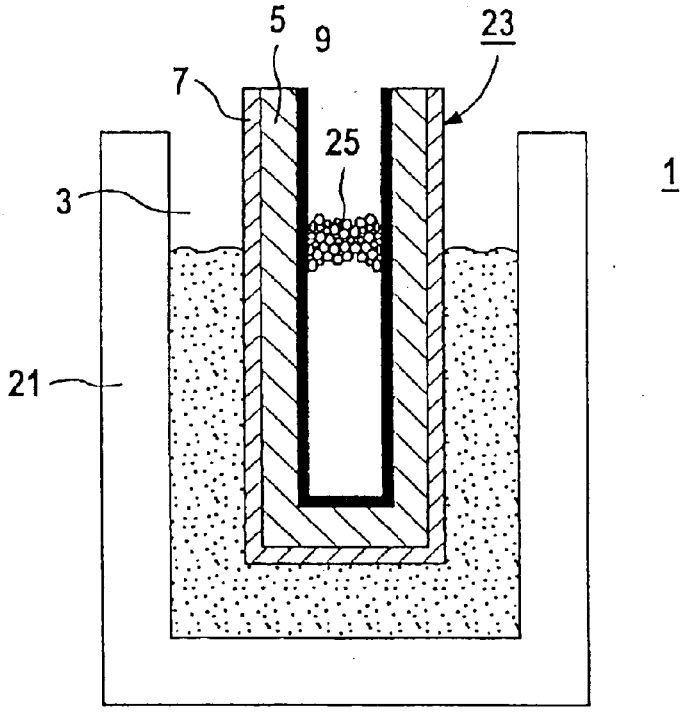
FIG. 2 shows a casting device for casting a hollow component.

FIG. 2 diagrammatically depicts a casting device 1 which makes it possible to cast a hollow component. A casting core 23, of the above-described structure including a front layer, an intermediate layer and an outer layer, is mounted in a conventional mold shell 21. In this case, the outer layer delimits an internal cavity in the casting core 23 which has been formed by burning out a filling comprising polystyrene beads 25.

Figure 3:
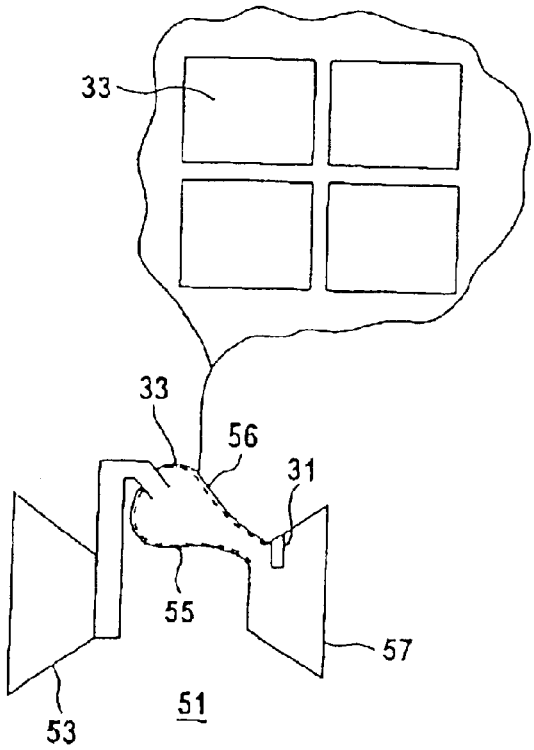
FIG. 3 shows a gas turbine.
Figure 4:
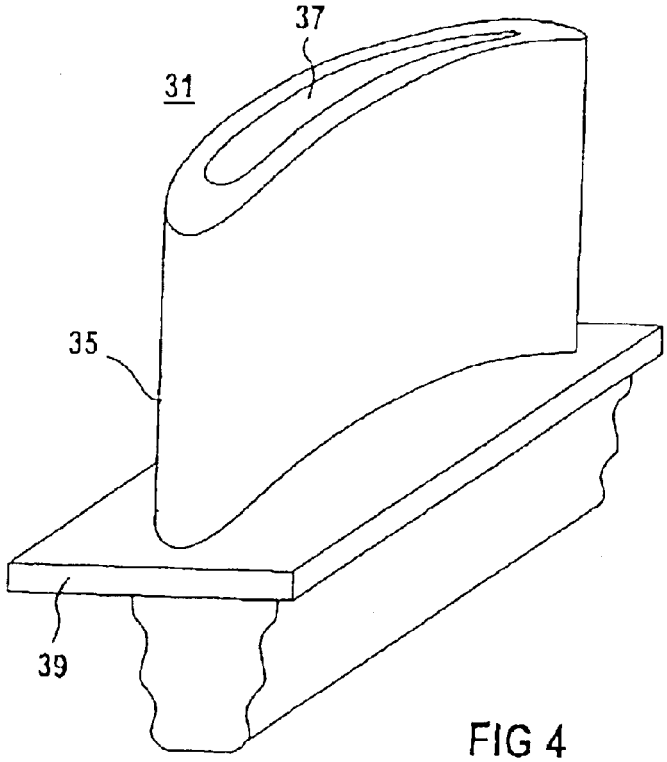
FIG. 4 shows a gas turbine blade or vane.

FIG. 3 diagrammatically depicts a gas turbine 51. The gas turbine 51 has a compressor 53, a combustion chamber 55 and a turbine part 57. The combustion chamber 55 has an inner combustion chamber lining 56. The combustion chamber lining 56 is formed from heat shield elements 33, such as those which are additionally illustrated on a larger scale. Gas turbine blades and vanes 31 are arranged in the turbine part 57. A gas turbine blade or vane 31 of this type is illustrated in more detail in FIG. 4. It has a blade or vane part 35 which encloses a cavity 37 for internal cooling. A securing region 39 adjoins the blade or vane part 35. Both the gas turbine blade or vane 31 and the heat shield element 33 are exposed to very high thermal loads. For this reason, special alloys, such as nickel-aluminum alloys, which have a particularly good high-temperature stability, are used here. Particularly in the case of a component which is also subject to particularly high mechanical loads as a result of centrifugal forces, for example a gas turbine blade or vane 31, cracks must be avoided at all costs during the casting process. This is achieved by the casting device 1 described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A casting device for casting a metallic component in a cavity, which is delimited by the casting device, comprising:

an outer layer;

a front layer facing the cavity; and an intermediate layer between the outer layer and the front layer, wherein the outer layer is harder than the intermediate layer, the intermediate layer being compressible and being designed to be sufficiently soft to yield to cooling-related contraction of the metallic component and being designed to absorb the contraction of the metallic component from a molten state, wherein the intermediate layer includes a ceramic binder.

2. The casting device as claimed in claim 1, wherein the front layer is substantially free of $SiO_2$.

3. The casting device as claimed in claim 1, wherein the intermediate layer is substantially free of $SiO_2$.

4. The casting device as claimed in claim 1, wherein the intermediate layer includes ground corundum as a base material of the intermediate layer.

5. The casting device as claimed in claim 4, wherein a substantially silica-free substance is added as binder to the intermediate-layer base material.

6. The casting device as claimed in claim 4, wherein octanol is added to the intermediate-layer base material as defoamer.

7. The casting device as claimed in claim 1, wherein the front layer includes ground corundum as a base material of the front layer.

8. The casting device as claimed in claim 7, wherein a substantially silica-free substance is added as binder to the front-layer base material.

9. The casting device as claimed in claim 7, wherein octanol is added to the front-layer base material as defoamer.

10. The casting device as claimed in claim 1, further comprising:

an outer layer, surrounding the intermediate layer and adjoining the intermediate layer, the outer layer being sufficiently hard to support the intermediate layer in such a manner that the intermediate layer retains its shape.

11. The casting device as claimed in claim 1, further comprising:

a mold shell, including the front layer and the intermediate layer; and a casting core, including the front layer and the intermediate layer arranged in the mold shell for the purpose of casting at least partially hollow components.

12. A process for producing the casting device as claimed in claim 1 including, hardening the casting device by a firing operation, the firing temperature being below 1300° C.

13. A process for producing the casting device as claimed in claim 11, including filling the casting core with a filler material, and hardening, by a firing operation, the filler material burning during the firing operation, wherein, as a result, the casting core is formed as a hollow core.

14. The casting device as claimed in claim 2, wherein the intermediate layer includes ground corundum as a base material of the intermediate layer.

15. The casting device as claimed in claim 14, wherein a substantially silica free substance is added as binder to the intermediate-layer base material.

16. The casting device as claimed in claim 14, wherein octanol is added to the intermediate-layer base material as defoamer.

17. The casting device as claimed in claim 10, wherein the intermediate layer includes ground corundum as a base material of the intermediate layer.

18. The casting device as claimed in claim 10, further comprising:

a mold shell, including the front layer and the intermediate layer; and a casting core, including the front layer and the intermediate layer arranged in the mold shell for the purpose of casting at least partially hollow components.

19. A casting device for casting a metallic component in a cavity, which is delimited by the casting device, comprising:

an outer layer;

a front layer facing the cavity; and an intermediate layer between the outer layer and the front layer, wherein the outer layer is harder than the intermediate layer, the intermediate layer being relatively softer than the front layer and being designed to be sufficiently soft to yield to cooling-related contraction of the metallic component and being designed to absorb the contraction of the metallic component from a molten state, wherein the intermediate layer includes a ceramic binder.

20. The casting device of claim 19, wherein the intermediate layer is relatively mechanically softer than the front layer.

21. The casting device of claim 19, wherein the intermediate layer has at least one of a relatively lower E-modulus and a relatively lower porosity than the front layer.

22. The casting device of claim 20, wherein the intermediate layer has at least one of a relatively lower E-modulus and a relatively lower porosity than the front layer.

23. A casting device for casting a metallic component in a cavity, which is delimited by the casting device, comprising:

an outer layer;

a front layer facing the cavity; and an intermediate layer between the outer layer and the front layer, wherein the outer layer is harder than the intermediate layer, the intermediate layer being designed to be sufficiently soft to yield to cooling-related contraction of the metallic component and being designed to absorb the contraction of the metallic component from a molten state, wherein the intermediate layer includes a ceramic binder.

24. A casting device for casting a metallic component, the casting device comprising:

an outer layer;

a front layer facing the cavity; and an intermediate layer between the outer layer and the front layer;

wherein the outer layer is harder than the intermediate layer, the intermediate layer being designed to be sufficiently soft to yield to cooling-related contraction of the metallic component and being designed to absorb the contraction of the metallic component from a molten state; and wherein the front layer is substantially free of $SiO_2$.

* * * * *